US005732612A

United States Patent [19]

Schienle et al.

[11] Patent Number: 5,732,612

[45] Date of Patent: Mar. 31, 1998

[54] ACTUATOR FOR A POSITION-ADJUSTING DEVICE, PREFERABLY FOR A VALVE LIFT ADJUSTING DEVICE OF MOTOR VEHICLES

[75] Inventors: Katja Schienle, Fellbach; Wolfgang Stephan, Nürtingen, both of Germany

[73] Assignee: Hydraulik-Ring Antriebs- und Steuerungstechnik GmbH, Nurtingen, Germany

[21] Appl. No.: 702,312

[22] Filed: Aug. 23, 1996

[30] Foreign Application Priority Data

Aug. 26, 1995 [DE] Germany ..... 195 31 444.1

[51] Int. Cl.[6] ..... F15B 11/08; E03B 1/00

[52] U.S. Cl. ..... 91/454; 91/459; 91/469; 137/625.65; 137/596.2

[58] Field of Search ..... 91/459, 418, 454, 91/469; 137/625.65, 596.2

[56] References Cited

U.S. PATENT DOCUMENTS

| | | | |
|---|---|---|---|
| 4,525,695 | 6/1985 | Sheng et al. | 137/625.65 X |
| 4,836,248 | 6/1989 | Stegmaier | 137/625.65 |
| 4,971,114 | 11/1990 | Ichihashi et al. | 137/625.65 |
| 5,127,435 | 7/1992 | Takata et al. | 137/625.65 |
| 5,592,972 | 1/1997 | Niethammer | 137/625.65 |
| 5,598,871 | 2/1997 | Sturman et al. | 137/625.65 |

*Primary Examiner*—Hoang Nguyen
*Attorney, Agent, or Firm*—Robert W. Becker & Associates

[57] ABSTRACT

The actuator for a position-adjusting device, wherein the position-adjusting device has a stationary part, a movable part, and at least one coupling element and wherein the at least one coupling element is hydraulically movable by the actuator for coupling and decoupling the stationary part and the movable part relative to one another, has a housing and at least one valve piston arranged within the housing so as to be movable between two end positions defining an open position and a closed position of the actuator. The housing has a work connector, a pressure-relieved tank connector, and a pressure-loaded tank connector. The pressure-loaded tank connector includes a pressure-limiting valve. The pressure-relieved pressure connector during displacement of the valve piston between the two end positions communicates with the work connector until a respective one of the two end positions is almost reached. In the closed position of the actuator the work connector is connected to the pressure-loaded tank connector.

4 Claims, 2 Drawing Sheets

ACTUATOR FOR A POSITION-ADJUSTING DEVICE, PREFERABLY FOR A VALVE LIFT ADJUSTING DEVICE OF MOTOR VEHICLES

BACKGROUND OF THE INVENTION

The present invention relates to an actuator for a position-adjusting device, preferably for a valve lift adjusting device of motor vehicles with at least one coupling element with which a stationary and a movable component of the adjusting device are coupled and which is adjustable hydraulically with at least one valve piston of the actuator wherein in the closed position at least one work connector is separated from a pressure connector.

For valve lift adjusting devices of motor vehicles it is known to use a bolt as a coupling element which, when necessary, is hydraulically displaced and couples a stationary adjusting element, that is coordinated with the second cam of the cam shaft, with a control element. Due to the presence of the second cam, the corresponding valve lifter of the motor vehicle performs a changed lift so that the opening cross-section can be changed to thereby allow the flow of an especially measured amount of fuel/air mixture into the cylinder chamber of the motor. In order for the coupling element to be displaced, the hydraulic medium must be loaded by a pump with pressure. A very short pressure drop within the system results until the pump has produced the required hydraulic pressure. This may cause the coupling element not to be inserted far enough into the locking bore so that, due to the frequent support on the bolt edge with increased surface pressure, an increased wear results.

It is therefore an object of the present invention to provide an actuator of the aforementioned kind such that the coupling element is suddenly displaced into its coupling position without running the risk that a force transmission takes place at a narrow edge portion of the coupling element.

SUMMARY OF THE INVENTION

The actuator for a position-adjusting device, wherein the position-adjusting device comprises a stationary part, a movable part, and at least one coupling element, wherein the at least one coupling element is hydraulically movable by the actuator for coupling and decoupling the stationary part and the movable part relative to one another, according to the present invention is primarily characterized by:

A housing;

At least one valve piston arranged within the housing so as to be movable between two end positions defining an open position and a closed position of the actuator;

The housing having a work connector, a pressure-relieved tank connector, and a pressure-loaded tank connector;

The pressure-loaded tank connector comprising a pressure-limiting valve;

The pressure-relieved pressure connector, during displacement of the valve piston between the two end positions, communicating with the work connector until a respective one of the two end positions is almost reached;

Wherein in the closed position of the actuator the work connector is connected to the pressure-loaded tank connector.

Advantageously, the valve piston comprises a first annular stay and in the closed position the first annular stay separates the pressure-relieved pressure connector from the work connector.

Preferably, the housing comprises a pressure connector, the valve piston comprises a second annular stay, and the second annular stay separates the pressure connector from the work connector in the closed position.

Advantageously, the actuator further comprises a throttle for connecting the pressure connector and the work connector. The throttle is preferably provided in the housing.

The actuator preferably further comprises a receiving element for receiving the housing, wherein the throttle is provided in the receiving element.

Advantageously, the valve piston has an axial bore with a bore throttle. The housing has a hydraulic chamber located at an end of the valve piston pointing in a direction into which the valve piston is moved for reaching the open position.

The inventive actuator comprises two tank connectors one of which is pressure-relieved and the other is pressure-loaded. Upon displacement of the valve piston the hydraulic medium is displaced via the pressure-relieved tank connector until the end position is almost reached because the tank connector is connected to the work connector. The hydraulic medium can be quickly displaced in this manner. Due to the pressure limiting valve of the pressure-loaded tank connector, it is ensured that in the entire system a residual pressure remains which is determined by the pressure limiting valve so that an emptying of the system is securely prevented. When it is desired to initiate the coupling process, a correspondingly large amount of hydraulic medium can suddenly made available so that a pressure drop at the beginning of the coupling process can be reliably prevented. The coupling element is thus suddenly displaced into the coupling position. Thus, there is no force transmission onto a narrow edge portion of the coupling element.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 3.

The actuator is preferably to be used for the valve lift adjusting device of motor vehicles. In such valve lift adjusting devices the cams of a cam shaft cooperate with pivot arms or hydrocups as control elements which act directly onto the respective valve lifter. Opening and closing of the valves are controlled by respective cams. Furthermore, the actuator can be used for a low pressure range in devices with residual pressure requirements.

Figure 1:
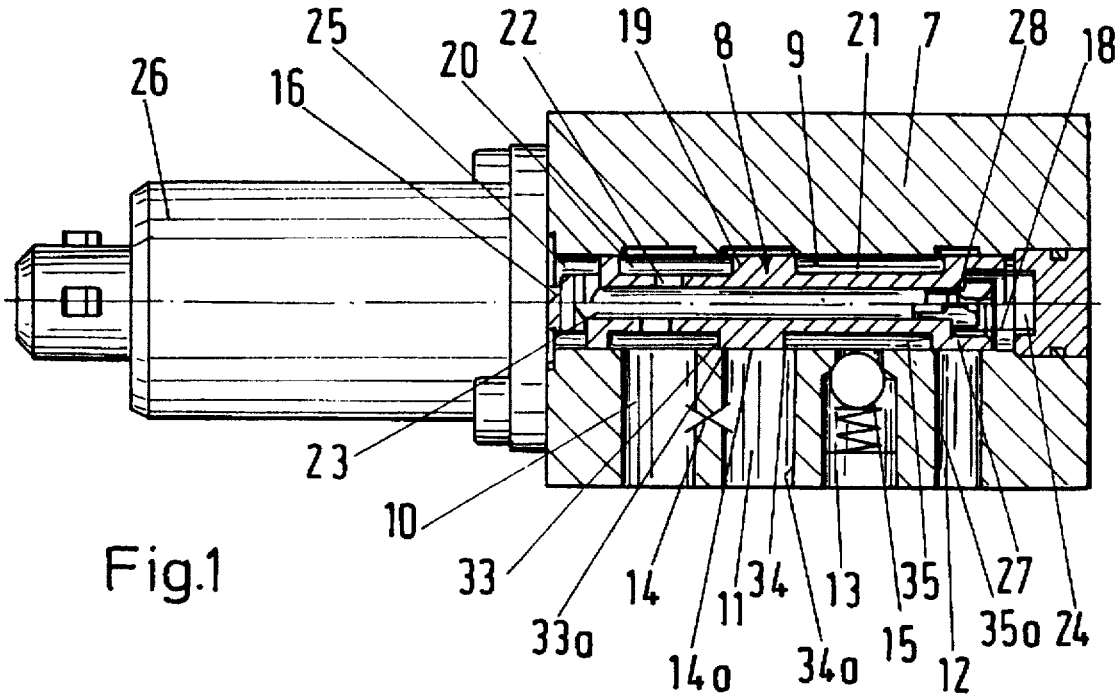
FIG. 1 shows an axial section of the inventive actuator in the form of a valve.
Figure 2:
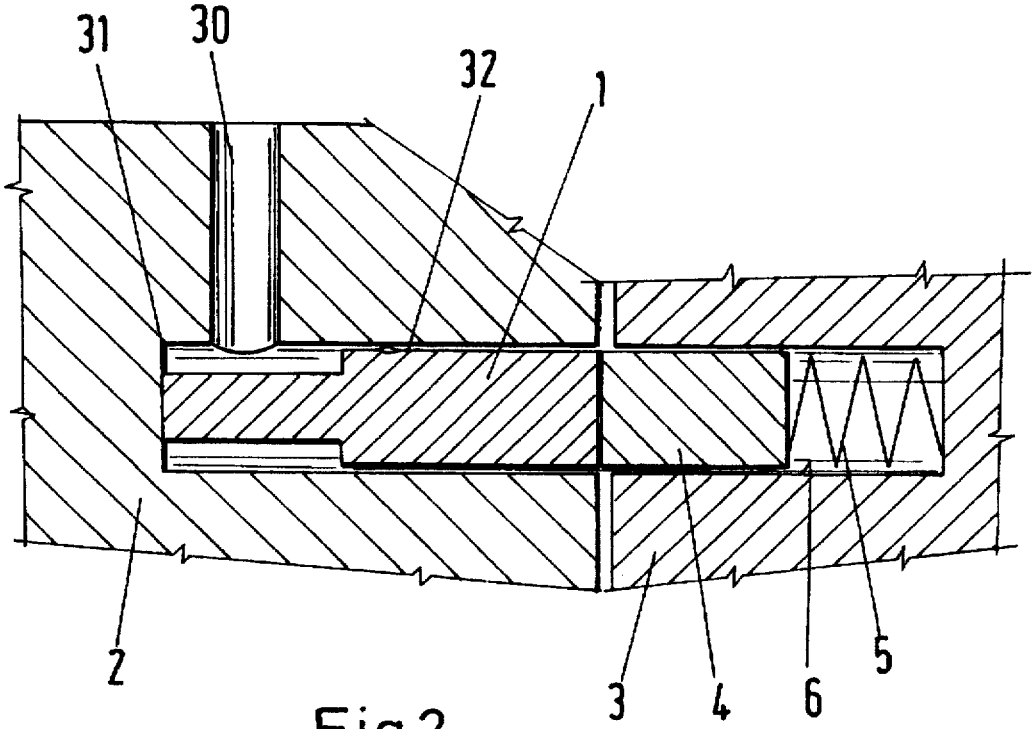
FIG. 2 shows in section and in a schematic representation a valve lift adjusting device which is actuated by the actuator of FIG. 1.

FIG. 2 shows schematically a valve lift adjusting device which is to be actuated with the actuator according to FIG. 1. A coupling element in the form of a piston 1 is displaceably positioned in a stationary component 2. Adjacent thereto a movable component 3 is provided in which a piston 4 is displaceably supported. The piston is loaded by the force of at least one pressure spring 5 or by hydraulic pressure.

In order to couple the two components 2 and 3 with one another, the coupling element 1 is hydraulically loaded so that it is displaced to the right in FIG. 2 and displaces the piston 4 against the force of the spring 5. The coupling element 1 is thus displaced to such an extent that it engages a bore 6 provided as a receiving element for the piston 4. Now both parts are coupled to one another transverse to the axis of the coupling element 1 and the piston 4 in a positive-locking manner.

For hydraulically loading the coupling element 1, the actuator according to FIG. 1 is provided. It is embodied as a switching valve and has a housing 7 in which the valve piston 8 is displaceably supported. It is displaceably supported in a bore 9 into which a pressure connector 10, a work connector 11, a pressure-relief tank connector 12, and a pressure-loaded tank connector 13 open. The work connector 11 is connected with a throttle 14 to the pressure connector 10. The throttle location 14*a* could also be embodied as a diameter play of the valve piston 8 within the bore 9. In this case, the throttle 14 would not be required. Due to the diameter play the hydraulic medium thus could also flow from the pressure connector 10 the work connector 11. The pressure-loaded tank connector 13 is closed off relative to the non-represented tank by a pressure-limiting valve 15 which opens in the direction toward the tank.

The valve piston 8 can be axially displaced by a push rod 16 of the solenoid 26 counter to the force of at least one spring 18 positioned in the bore 9. The valve piston 8 has two annular grooves 20 and 21 separated from one another by an annular stay 19. The annular groove 20 is connected with a radial bore 22 to a bore 23 axially penetrating the valve piston 8. These bores 22 and 23 serve for hydraulically relieving the chambers 24 and 25 positioned at either end of the valve piston 8. The resulting leakage oil is removed via the bores 22, 23, the annular groove 21, and the tank connectors 12 and 13.

In the upper half of FIG. 1, the valve piston 8 is represented in its open position, in which the solenoid 26 is excited and the push rod 16 is extended so that the valve piston 8 is displaced counter to the force of the pressure spring 18. The pressure connector 10 and the work connector 11 are connected by the annular groove 20 while the work connector 11 is separated from the pressure-relieved tank connector 12 and the pressure-loaded tank connector 13 by the annular stay 19 of the valve piston 8. Via throttle 14 the work connector 11 is also in communication with the pressure connector 10.

In the lower half of FIG. 1, the valve piston 8 is represented in its closed position in which the solenoid 26 is not excited. The push rod 16 is thus in the returned position and the valve piston 8 has been returned by the force of the spring 18 into its closed position. In this switching position the work connector 11 is connected via the annular groove 21 with the pressure-loaded tank connector 13. The hydraulic medium in this closed position can flow via the throttle 14 from the work connector 11 into the pressure connector 10. This measure prevents an emptying of the system during operation of the motor. Thus, leakage, for example, due to lubricating locations, are compensated. The hydraulic medium can flow from the work connector 11 via the annular groove 21 of the valve piston 8 and the tank connector 13 to the tank.

A work line 30 (FIG. 2) of the stationary component 2 is connected to the work connector 11 so that the coupling element 1 is also loaded by this pressure of the hydraulic medium. However, this pressure is smaller than the pressure exerted by the pressure spring onto the piston 4 and thus onto the coupling element I. Thus, the coupling element 1 remains in its abutment position represented in FIG. 2 in which it rests at the bottom 31 of the bore 32 receiving the coupling element.

The valve piston 8 has a further annular stay 27 at its end facing the pressure spring 18 which together with the annular stay 19 delimits the annular groove 21 in the axial direction. In the closed position of the valve piston 8 (lower half of FIG. 1) the annular stay 27 closes off the pressure-relieved tank connector 12. In the open position (upper half of FIG. 1) the tank connector 12 is partly closed by the annular stay 27. Upon returning the valve piston 8 from the open position into the closed position, the hydraulic medium is displaced via the pressure-relieved tank connector 12 until the valve piston 8 has almost completely reached its end position (lower half in FIG. 1). Only then the pressure-relieved tank connector 12 is separated from the annular groove 21 by the annular stay 27, while the pressure-loaded tank connector 13 is in communication via the annular groove 21 with the work connector 11.

Since the hydraulic medium is freely displaced upon return via the pressure-relieved tank connector 12, the valve piston 8 can be reliably returned by the pressure spring 18 into its closed position in which it separates the pressure connector 10 from the work connector 11 with the annular stay 19.

For damping during the switching process the valve piston 8 has a bore 28 axially penetrating it which acts as a throttle location and is in the form of a nozzle. It opens into the central axial bore 23. The throttle location 28 can, of course, have any other suitable embodiment, for example, in the form of a reduction of the diameter of the bore 23.

The two annular stays 19 and 27 of the valve piston 8 together provide the control edges 33, 34, and 35 which cooperate with corresponding control edges 33*a* to 35*a* of the housing 7. These control edges 33*a* to 35*a* are provided at the work connector 11 as well as at the pressure-relieved tank connector 12. The control edges 33 to 35 and 33*a* to 35*a* are embodied such relative to one another that overlap is very small and is thus generally referred to as "zero overlap".

When the valve piston 8 is in its closed position (lower half of FIG. 1), the work connector 11 is connected to the pressure-loaded tank connector 13 via annular groove 21. The pressure-limiting valve 15 ensures that the entire system in this non-switched state of the actuator also has a corresponding residual pressure. This prevents an emptying of the system in the closed position of the valve piston 8.

Upon return of the valve piston 8 from the open position (upper half of FIG. 1) into the closed position (lower half of FIG. 1) the hydraulic medium is removed via the pressure-relieved tank connector 12 to the tank, while the pressure-loaded tank connector 13 remains closed due to the pressure-limiting valve 15. Shortly before the valve piston 8 reaches its closed position, the pressure-relieved tank connector 12 is closed. The pressurized hydraulic medium is then removed at the end of the displacement stroke of the valve piston 8 via the pressure-loaded tank connector 13 as long as the pressure of the hydraulic medium is greater than the pressure defined by the pressure-limiting valve 15.

When the valve piston 8 is moved by the push rod 16 into its open position, the annular stay 27 frees already after a very short displacement stroke the pressure-relieved tank connector 12 so that the hydraulic medium can flow to the tank via this tank connector 12. In the end position the annular stay 19 separates the work connector 11 from the tank connector 12.

Figure 3:
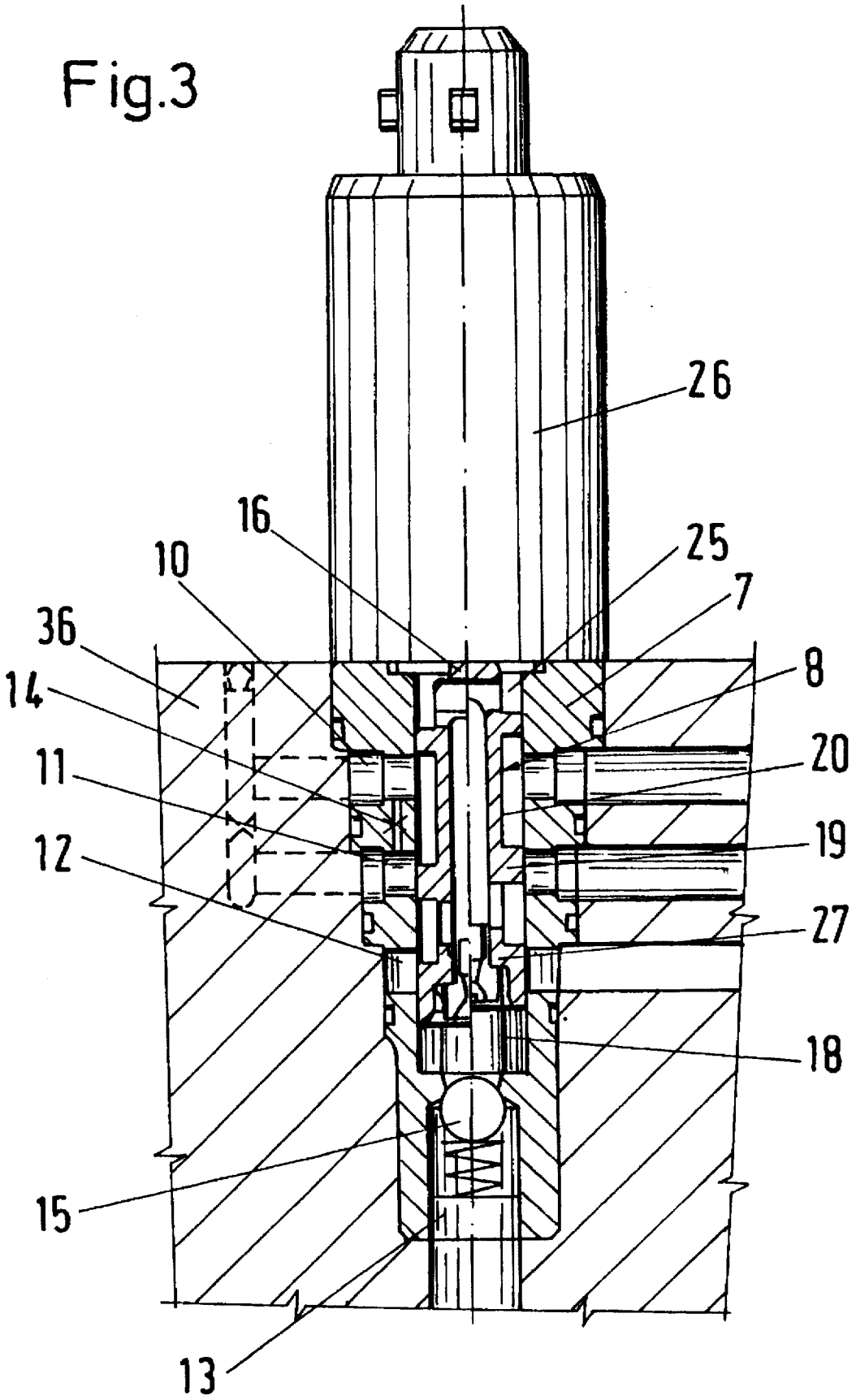
FIG. 3 shows in axial section a second embodiment of the inventive actuator.

In the embodiment according to FIG. 3 the actuator is a cartridge valve. The solenoid 26 is fixedly connected to the housing 7 and the solenoid/housing unit is inserted in a corresponding receiving element 36. The actuator has also a pressure connector 10, a work connector 11, a pressure-relieved tank connector 12, a pressure-loaded tank connector 13, in which a pressure-limiting valve is provided, and a throttle 14. The valve piston 8 is displaced by the push rod 16 of the solenoid 26 from its closed position (right half of FIG. 3) counter to the force of the pressure spring 18 into the open position (indicated in the left half of FIG. 3). In this open position of the valve piston 8 the pressure connector 10 is connected via the annular groove 20 with the work connector 11 which is separated by the annular stays 19, 27 of the valve piston 8 from the two tank connectors 12, 13.

The pressure-loaded tank connector 13, in contrast to the aforementioned embodiment, is positioned in the axial direction of the valve piston 8 as well as of the solenoid 26. The operation of the actuator however is the same. Both embodiments thus function and operate in the same manner as disclosed in connection with the embodiment of FIG. 1.

When the solenoid 26 is switched off and the push rod 16 is returned, the valve piston 8 is returned by the force of the pressure spring 18 into the closed position. The annular stay 27 of the valve piston 8 first does not close off the pressure-relieved tank connector 12 during displacement of the valve piston 8 so that the displaced hydraulic medium can be returned quickly via the tank connector 12 into the tank. Only shortly before the valve piston 8 reaches its closed position (right half of FIG. 3), the pressure-relieved tank connector 12 is closed by the annular stay 27. As in the previous embodiment, the pressure limiting valve 15 ensures that also for a non-excited solenoid 26 the system maintains a corresponding residual pressure so that an emptying of the system is prevented.

FIG. 3 shows in dashed lines an embodiment in which the throttle between the pressure connector 10 and the work connector 11 is not provided in the housing 7 but within the receiving element 36.

The present invention is, of course, in no way restricted to the specific disclosure of the specification and drawings, but also encompasses any modifications within the scope of the appended claims.

What we claim is:

1. An actuator for a position-adjusting device, wherein the position-adjusting device comprises a stationary part, a moveable part, and at least one coupling element, wherein the at least one coupling element is hydraulically moveable by said actuator for coupling and decoupling the stationary part and the moveable part relative to one another, said actuator comprising:

a housing;

at least one valve piston arranged within said housing so as to be moveable between two end positions defining an open position and a closed position of said actuator;

said housing having a work connector, a pressure-relieved tank connector and a pressure-loaded tank connector;

said pressure-loaded tank connector comprising a pressure-limiting valve;

said pressure-relieved tank connector during displacement of said valve piston between said two end positions communicating with said work connector until a respective one of said two end positions is almost reached;

wherein in said closed position of said actuator said work connector is connected to said pressure-loaded tank connector;

said valve piston comprising a first annular stay;

said first annular stay separating said pressure-relieved tank connector from said work connector in said closed position;

said housing comprising a pressure connector;

said valve piston comprising a second annular stay;

said second annular stay separating said pressure connector from said work connector in said closed position; and a throttle connecting said pressure connector and said work connector.

2. An actuator according to claim 1, wherein said throttle is provided in said housing.

3. An actuator according to claim 2, further comprising a receiving element for receiving said housing, wherein said throttle is provided in said receiving element.

4. An actuator according to claim 3, wherein:

said valve piston has an axial bore with a bore throttle;

said housing has a hydraulic chamber located at an end of said valve piston pointing in a direction into which said valve piston is moved for reaching said open position.

* * * * *